US005832635A

United States Patent [19]

Finney et al.

[11] Patent Number: 5,832,635

[45] Date of Patent: Nov. 10, 1998

[54] APPARATUS FOR ADJUSTING THE FORWARD LEAN AND FLEXIBILITY OF FOOTWEAR

[75] Inventors: Todd R. Finney; Seth W. Bayer, both of Boulder, Colo.; Toren Orzeck; Mark Schoening, both of Portland, Oreg.

[73] Assignee: Items International, Inc., Altoona, Pa.

[21] Appl. No.: 856,525

[22] Filed: May 14, 1997

Related U.S. Application Data

[63] Continuation of Ser. No. 785,667, Jan. 17, 1997, abandoned.

[51] Int. Cl.[6] ..... A43B 5/04

[52] U.S. Cl. ..... 36/118.8; 36/118.2; 36/118.3; 36/115

[58] Field of Search ..... 36/118.8, 118.9, 36/118.2, 118.3, 118.5, 118.7, 119.1, 115

[56] References Cited

U.S. PATENT DOCUMENTS

| | | | |
|---|---|---|---|
| 3,543,421 | 12/1970 | Ader | 36/2.5 |
| 3,633,291 | 1/1972 | Caporicci | 36/118.8 |
| 3,686,778 | 8/1972 | Hornung | 36/2.5 AL |
| 3,732,635 | 5/1973 | Marker | 36/2.5 AL |
| 3,807,060 | 4/1974 | Hanson et al. . | |
| 3,945,134 | 3/1976 | Ramer | 36/2.5 AL |
| 3,945,135 | 3/1976 | Hanson et al. . | |
| 4,138,828 | 2/1979 | Kubelka . | |
| 4,152,849 | 5/1979 | Frechin et al. | 36/120 |
| 4,281,468 | 8/1981 | Giese et al. | 36/121 |
| 4,349,971 | 9/1982 | Everest, III . | |
| 4,367,885 | 1/1983 | Ramer | 280/614 |
| 4,379,370 | 4/1983 | Balbinot | 36/121 |
| 4,447,970 | 5/1984 | Delery | 36/118.8 |
| 4,455,769 | 6/1984 | Fritsch | 36/118.8 |
| 4,575,957 | 3/1986 | Petrini | 36/118.9 |
| 4,665,635 | 5/1987 | Benoit et al. | 36/120 |
| 4,748,751 | 6/1988 | Sartor | 36/119 |
| 4,765,069 | 8/1988 | Baggio et al. | 36/118.9 |
| 4,793,077 | 12/1988 | Walkhoff et al. | 36/117 |
| 4,825,566 | 5/1989 | Sartor | 36/117 |
| 4,839,973 | 6/1989 | Dodge | 36/121 |
| 4,888,889 | 12/1989 | Sartor . | |
| 4,928,406 | 5/1990 | Montfort . | |
| 5,031,340 | 7/1991 | Hilgarth | 36/117 |
| 5,031,341 | 7/1991 | Paris et al. | 36/121 |
| 5,033,210 | 7/1991 | Dodge et al. | 36/121 |
| 5,109,615 | 5/1992 | Sartor | 36/121 |
| 5,136,794 | 8/1992 | Stampacchia et al. . | |
| 5,216,826 | 6/1993 | Chaigne et al. . | |
| 5,329,707 | 7/1994 | Chaigne et al. | 36/120 |
| 5,341,584 | 8/1994 | Paris et al. | 36/117 |
| 5,363,572 | 11/1994 | Marega et al. . | |
| 5,426,871 | 6/1995 | Spademan et al. | 36/120 |
| 5,435,080 | 7/1995 | Meiselman . | |
| 5,461,802 | 10/1995 | Paris et al. | 36/121 |
| 5,485,688 | 1/1996 | Gorza et al. | 36/117 |
| 5,493,793 | 2/1996 | Pozzobon et al. | 36/120 |
| 5,560,128 | 10/1996 | Marega et al. | 36/118.7 |
| 5,564,204 | 10/1996 | Cagliari et al. | 36/118.7 |
| 5,606,808 | 3/1997 | Gilliard et al. . | |
| 5,651,199 | 7/1997 | Chaigne et al. | 36/118.3 |
| 5,722,187 | 3/1998 | Pamio et al. | 36/115 |

FOREIGN PATENT DOCUMENTS 42 02 788 A1 8/1992 Germany .

*Primary Examiner*—M. D. Patterson

*Attorney, Agent, or Firm*—Reed Smith Shaw & McClay LLP

[57] ABSTRACT

A footwear includes an upper portion connected to a sole and a highback connected to the upper portion. An adjusting mechanism is operably associated with the highback. The adjusting mechanism includes at least one flexible member connectively associated with the highback and a locking member operably associated with the flexible member. The adjusting mechanism is operable to lock the footwear in one or more substantially rigid positions and can be used to set a forward leaning position of the footwear.

22 Claims, 11 Drawing Sheets

APPARATUS FOR ADJUSTING THE FORWARD LEAN AND FLEXIBILITY OF FOOTWEAR

CROSS-REFERENCE TO RELATED APPLICATION

This application is a continuation of application Ser. No. 08/785,667, filed Jan. 17, 1997, now abandoned, the contents of which are hereby incorporated by reference.

BACKGROUND OF THE INVENTION

The present invention relates generally to the field of footwear and, more particularly, to an apparatus for adjusting the forward leaning position and flexibility of snowboard, ski and skating boots and the like.

Snowboarding and in-line skating have become very popular sporting and recreational activities in the United States and other countries over the past few years. To safely and effectively snowboard, a snowboarder must typically wear boots, which are secured to the snowboard by means of snowboard bindings. Similar to ski boots, to allow the snowboarder to effectively maneuver the snowboard during a downhill run and to strengthen and protect the snowboarder's ankles during a fall, snowboard boots are substantially inflexible.

In snowboarding, and to a lesser degree in skiing, the ability of the snowboarder to control with great precision the maneuvering of the snowboard during a ride often requires that the snowboarder be able to lean forward during the ride. Additionally, at times snowboarders must be able to shift their weight by leaning from side to side and even rotate their lower legs to control and maneuver the snowboard for crisp and precise turning or to perform airborne stunts. This weight maneuvering must be performed while the snowboarder's feet remain firmly engaged in their respective boots. Moreover, the degree to which the snowboarder must lean forward, move side to side and rotate his or her lower legs while remaining engaged in the boots can vary with the snow conditions, terrain, and the snowboarder's skill level.

Because snowboard and ski boots are relatively inflexible, they do not conveniently and comfortably permit the user to ride in a forward leaning position or allow the user to shift its weight in a side to side or rotated manner. While ski boots with preadjusted forward leaning positions are known, these boots typically do not readily permit the user to lean side to side or to rotate when engaged in the boot. Consequently, a mechanism to permit a user to adjust and vary the forward leaning position of a boot and a mechanism to also provide flexibility in the boot so that the user can lean side to side or rotate while the foot is engaged in the boot, has been desired. Additionally, a device whereby the user can choose and vary the stiffness of the footwear in response to rotational, side to side or front to back movements to accommodate personal preferences and skill level, as well as varying snow conditions or terrain, has also been desired.

Further, as every novice or seasoned snowboarder, skier or skater can appreciate, the inflexibility of snowboard, ski, and skating boots renders them difficult and ungainly to walk in. Unfortunately, however, it is often necessary for snowboarders, skiers and skaters to walk in their boots. For example, snowboarders and skiers often carry their respective snowboards and skis between the ski lodge and the lifts. Furthermore, because snowboarders do not use poles and have both feet secured to a single board, snowboarders must remove at least one boot from the snowboard and propel themselves "skateboard" fashion along the ground to maneuver from the bottom of a slope to a lift after a downhill run. In addition, in-line skaters often must walk in their skates to a street or skating area, or at rest stops or their final destination (e.g., stores, cafes or other private and public venues or establishments). Moreover, ice and roller skaters often must walk in their skating boots between the locker room or rest area and the ice or roller rink.

Even though the manufacturers of snowboarding, skiing and skating equipment have long realized that the conventional design of snowboard, ski and skating boots makes it difficult for snowboarders, skiers and skaters to walk in them, to date a satisfactory snowboard, ski or skating boot that provides relative flexibility for ease of walking and substantial inflexibility for safe and effective downhill runs and skating has not been devised. Accordingly, a device that permits a boot to be flexible during walking but can be set to provide proper stiffness for use of the boot in snowboarding, skiing or skating has been desired.

SUMMARY OF THE INVENTION

The present invention provides a footwear, such as a boot or a skate, that is relatively or substantially inflexible for its intended activity yet relatively flexible for walking and the like. Additionally, the present invention also provides for a footwear that can be set to a predetermined forward leaning position during use of the footwear for activities such as snowboarding, skiing or skating and provide resistance to rearward movement of the footwear while maintaining a degree of flexibility of the footwear for side to side or rotational movement of the user. The present invention also provides for footwear where the degree of stiffness can be varied by the user with relative ease.

According to a first aspect of the present invention, a footwear includes a mechanism that permits the footwear to be adjusted between a relatively or substantially inflexible state and a relatively or substantially flexible state.

According to a second aspect of the present invention, a footwear includes a mechanism that permits the footwear to be adjusted along a continuum between a substantially inflexible state and a substantially flexible state.

According to a third aspect of the present invention, a footwear includes an upper portion connected to a sole. A locking mechanism is operably associated with the upper portion to render the boot substantially rigid in one or more directions.

According to a fourth aspect of the present invention, a footwear includes an upper portion connected to a sole and a highback connected to the upper portion. The highback includes at least one flexible member, which operates to allow the footwear to flex in various directions. A locking member is operably associated with the flexible member to lock the footwear in at least one substantially rigid position.

According to a fifth aspect of the present invention, a footwear includes an upper portion connected to a sole and a highback connected to the upper portion. An adjusting mechanism is operably associated with the highback. The adjusting mechanism includes at least one flexible member connectively associated with the highback and a locking member operably associated with the flexible member. The adjusting mechanism is operable to lock the footwear in at least one substantially rigid position.

According to a sixth aspect of the present invention, a footwear includes an upper portion connected to a sole and a highback connected to the upper portion. The highback includes a plurality of connectively associated spine members. A flexible member is connectively associated with at least one of the plurality of spine members. A locking member is operably associated with the flexible member to lock the footwear in one or more of a plurality of substantially rigid positions.

The present invention provides a footwear, such as a boot or a skate, that allows its wearer to walk in a relatively conventional and comfortable manner yet safely engage in the footwear's intended activity. For example, in one aspect of the present invention, a snowboard boot is sufficiently flexible in one state to allow a snowboarder to walk therein with relative ease yet sufficiently inflexible in another state to allow the snowboarder to safely and effectively snowboard. Additionally, the present invention provides a footwear that can be adjusted in a substantially inflexible forward leaning position, while providing a degree of flexibility for side to side or rotational movement of the user.

The present invention, together with other aspects and attendant advantages thereof, will best be understood upon consideration of the following detailed description taken in conjunction with the following drawings.

SUMMARY OF THE DRAWINGS

FIG. 11 A is a side view taken along line A—A of FIG. 11.

DETAILED DESCRIPTION OF THE PRESENTLY PREFERRED EMBODIMENTS

The present invention is described below in terms of a snowboard boot. However, it should be understood that the present invention is applicable to ski boots, skating boots and like footwear that are relatively stiff, rigid or inflexible.

Figure 1:
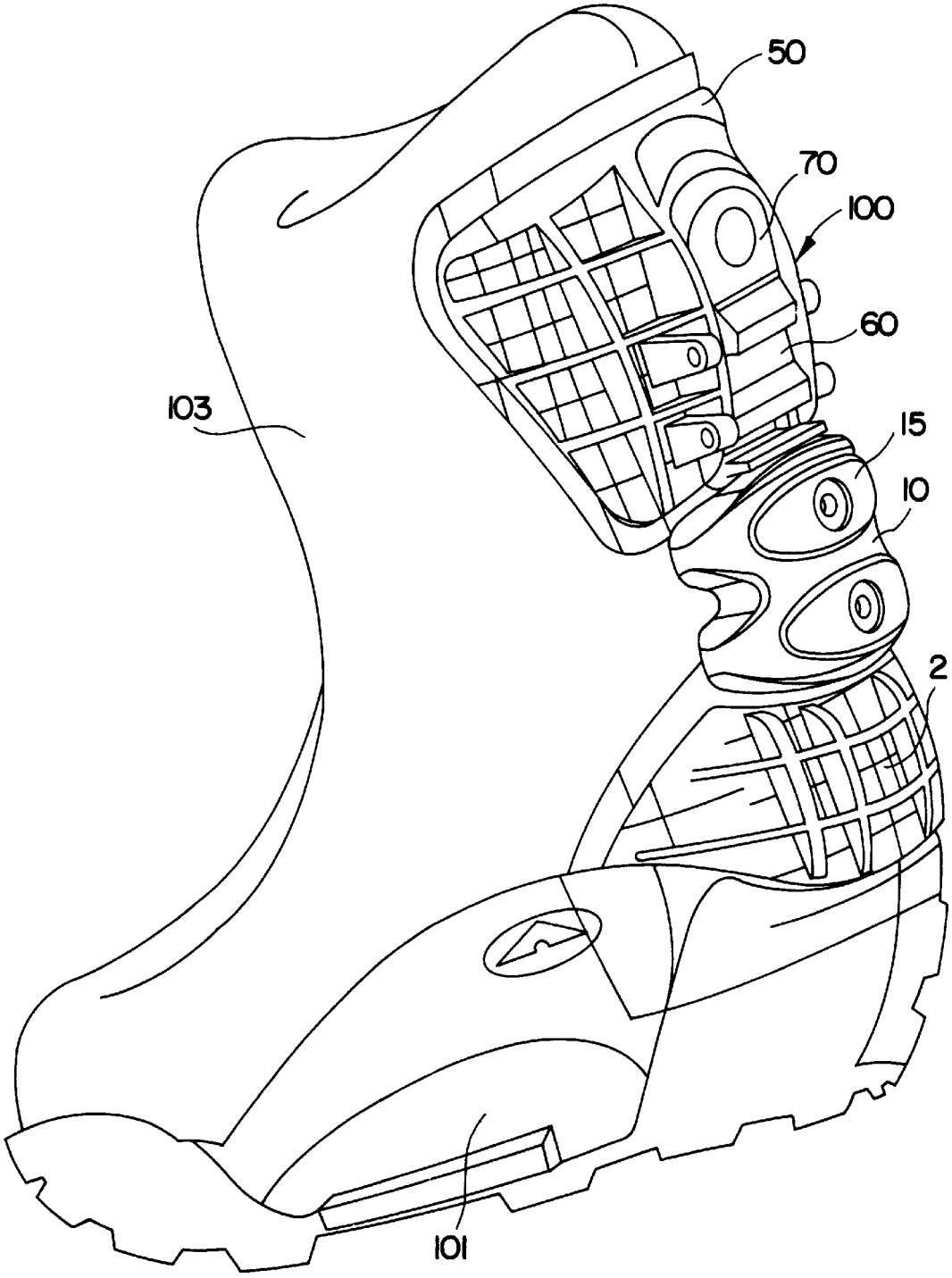
FIG. 1 is a perspective view of a preferred embodiment of the present invention.

Turning now to the drawings, as shown in FIG. 1, the footwear is generally comprised of an upper portion 103 connected to a sole 101 with a highback 100 integral with the footwear or externally mounted and secured to the rear of the footwear.

Figure 2:
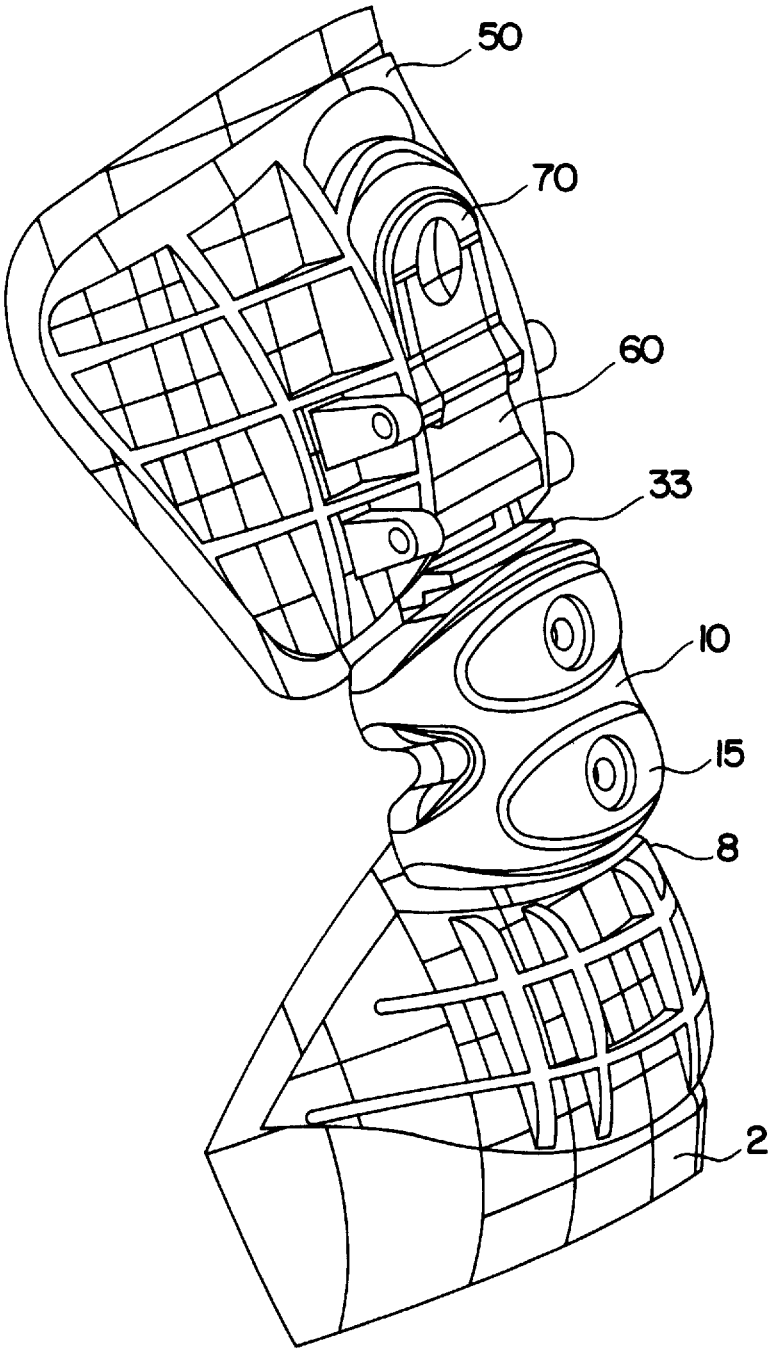
FIG. 2 is a perspective view of the highback shown in FIG. 1.
Figure 3:
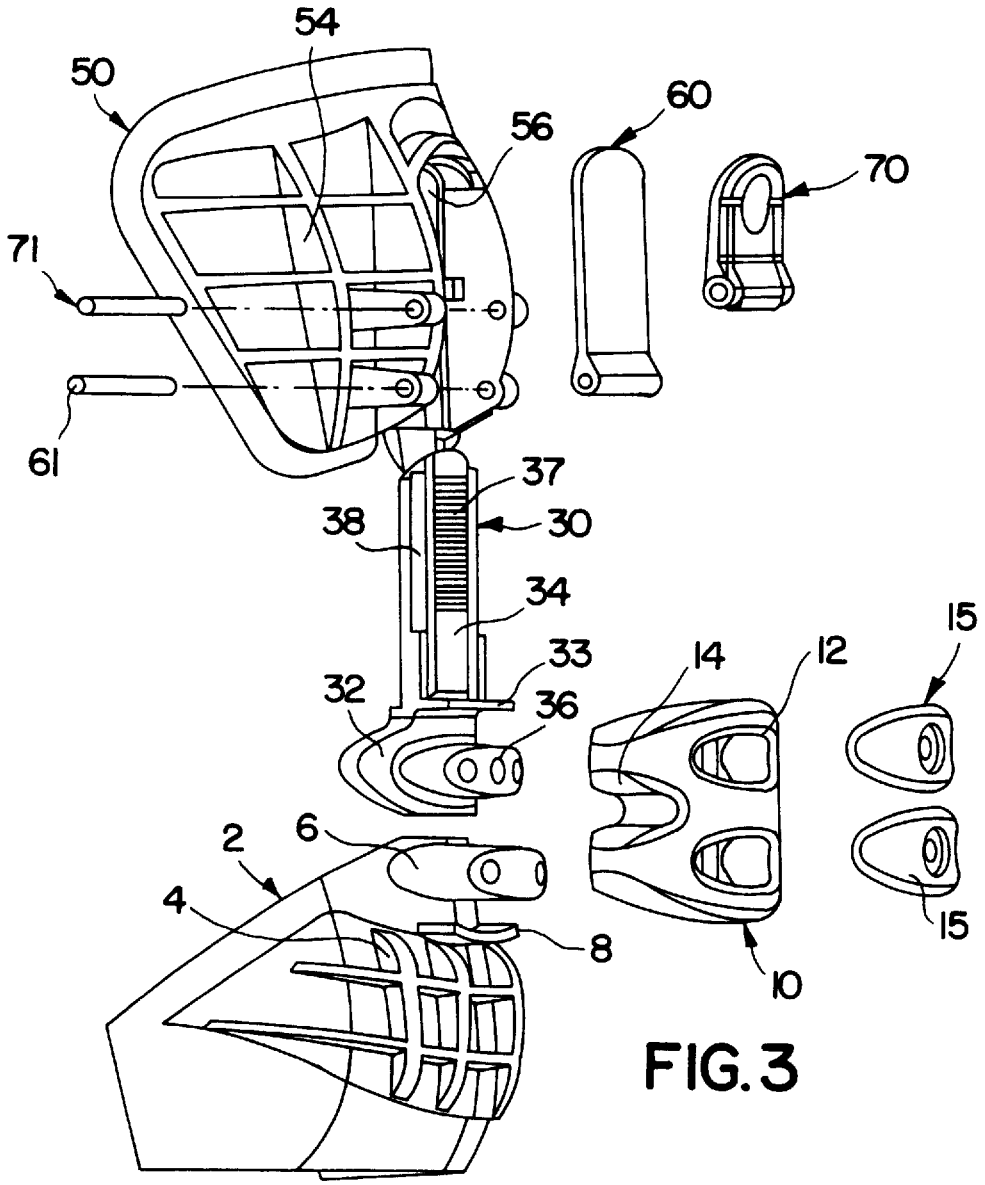
FIG. 3 is an exploded perspective view of the highback as shown in FIGS. 1 and 2.

In a preferred embodiment, the highback 100 is generally comprised of a heel cuff 2, an upper cuff 50, a tongue member 30 and a flexible connecting member 10. As shown in FIGS. 2 and 3, the heel cuff 2 is adapted to surround generally the upper heel of the footwear. A ridge 8 protrudes substantially horizontally from the rear face of the heel cuff 2. The ridge 8 forms a bottom wall above which the flexible connecting member 10 is disposed. The ridge 8 acts to limit the downward movement of the flexible connecting member 10 during use of the footwear. A hub 6 protrudes substantially horizontally from the rear face of the heel cuff 2 and above the ridge 8. In one embodiment, the hub 6 is elliptically shaped, although the shape is not critical to the invention so long as the hub 6 can connectively engage the flexible connecting member 10. Stiffening ribs 4 may be added to the heel cuff 2 as shown in FIG. 3 to provide for increased strength to resist the stresses encountered during use of the footwear.

Figure 7:
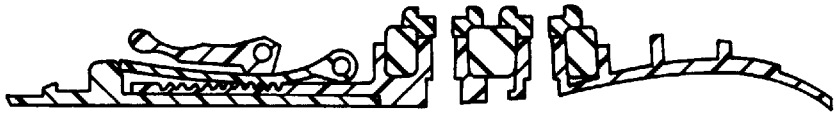
FIG. 7 is a cross-sectional view of a preferred embodiment of the present invention along the line A—A shown in FIG. 6.
Figure 6:
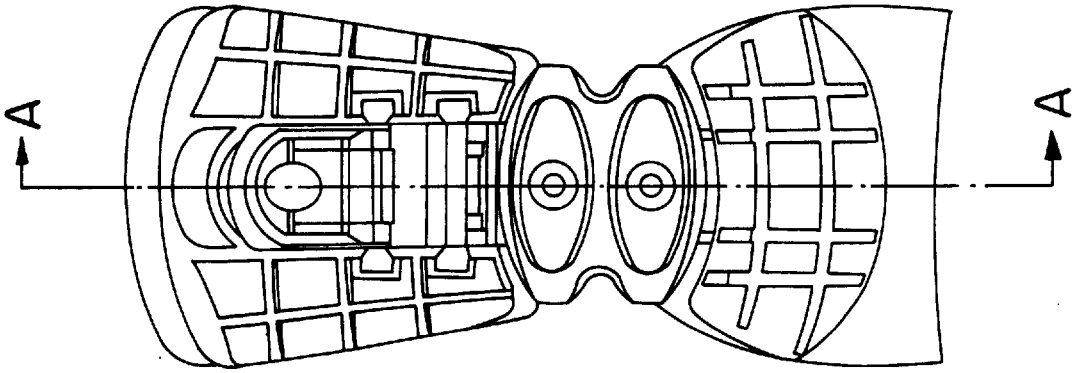
FIG. 6 is a rear view of the highback as shown in FIG. 1.
Figure 5:
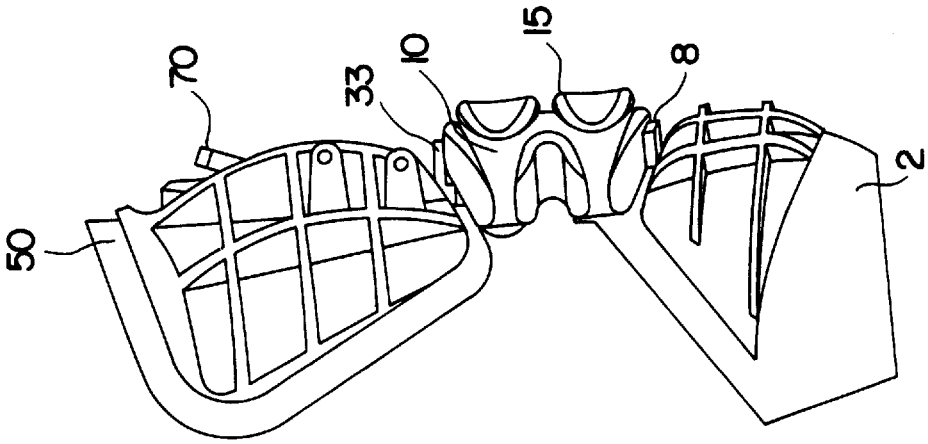
FIG. 5 is a side view of the highback as shown in FIG. 1.

A tongue member 30 is disposed above the heel cuff 2. The tongue member 30 generally includes a vertically projecting engaging portion 34, which will engage the upper cuff 50, and a base 32. The outward rear facing surface of the engaging portion 34 of the tongue member 30 contains a plurality of teeth 37 that matingly engage teeth present on the cover plate 60 of the upper cuff 50, as shown in FIGS. 3 and 7. The sides of the engaging portion 34 can contain guide rails 38, as shown in FIG. 3, or other suitable mechanisms to facilitate the seating of the tongue member 30 into the upper cuff 50. A ridge 33, projecting substantially horizontally, is disposed between the engaging portion 34 and the base 32. The ridge 33 forms a top wall below which the flexible connecting member 10 will be disposed. The ridge 33 limits the upward movement of the flexible connecting member 10 during use of the footwear. The base of the tongue member 30 contains a hub 36 protruding substantially horizontally, as shown in FIGS. 2 and 3. In one embodiment, the hub 36 is elliptically shaped, although the shape is not critical to the invention so long as the hub 36 can connectively engage the flexible connecting member 10.

A flexible connecting member 10 is mounted on the hub of the heel cuff 6 and the hub of the tongue member 36, thereby connecting the upper cuff 50 to the heel cuff 2. The connecting member 10 contains holes 12 that correspond in shape to the shapes of the heel cuff hub and tongue member hub. Removable retaining caps 15 are mounted over the holes in the connecting member 10 and secured to the hubs of the heel cuff 2 and the tongue member 30, thereby securing the flexible connecting member 10 to these components.

The flexible connecting member 10 permits a substantially rigid vertical connection of the upper cuff 50, via the tongue member 30, to the heel cuff 2 while the inherent flexibility of the connecting member 10 permits the upper and heel cuffs to move relative to each other when the user shifts its weight by leaning side to side or rotating its body. Additionally, the inherent flexibility of the connecting member 10 dampens vibration of the footwear during a ride, which reduces "heel chatter." The substantially vertical rigidity achieved with the use of the highback 100 improves the transfer of energy between the user's lower leg and the snowboard, ski, or skate blade, thereby reducing rider fatigue.

Figure 4:
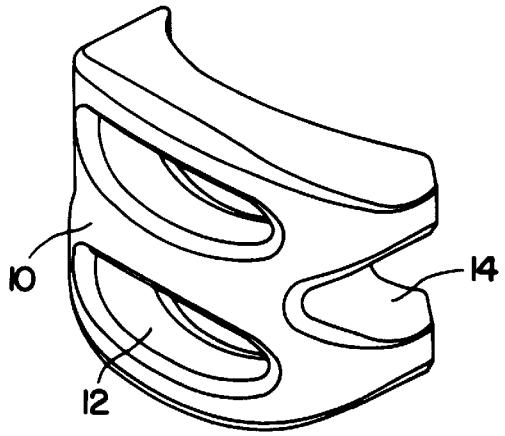
FIGS. 4, 4*a*, 4*b*, and 4*c* are perspective, side, front and top views, respectively, of the flexible connecting member shown in FIG. 3.
Figure 4A:
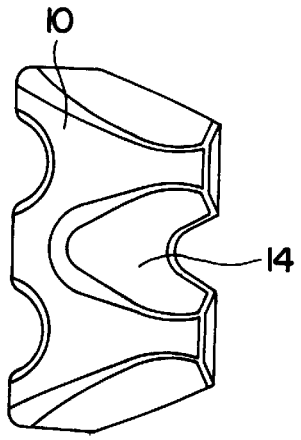
Figure 4B:
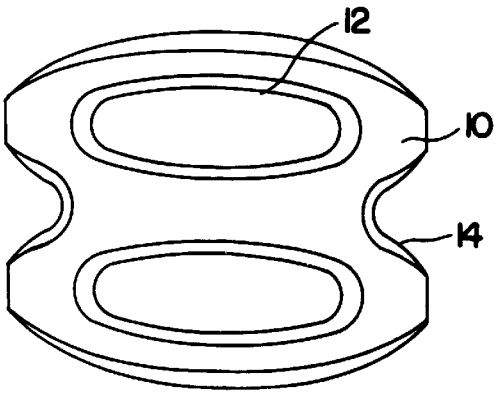
Figure 4C:
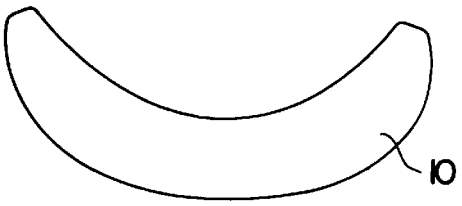

To increase the rotational and side to side flexibility of the connecting member 10, a portion of the side 14 of the connecting member 10 can be cut away as shown in FIG. 4. It is contemplated that connecting members of different material hardness may be used with the invention to vary the stiffness of the footwear to resisting rotational, side to side or forward and rearward flexure.

The upper cuff 50, disposed above the tongue member 30, is generally contoured to fit around the back of the user's leg above the ankle. Stiffening ribs 54 may be added to the upper cuff 50 as shown in FIG. 3 to provide for increased strength to resist the stresses encountered during use of the footwear. A receiving channel 56 adapted to receive the engaging portion 34 of the tongue member 30 is disposed on the rear face of the upper cuff 50.

Figure 7A:
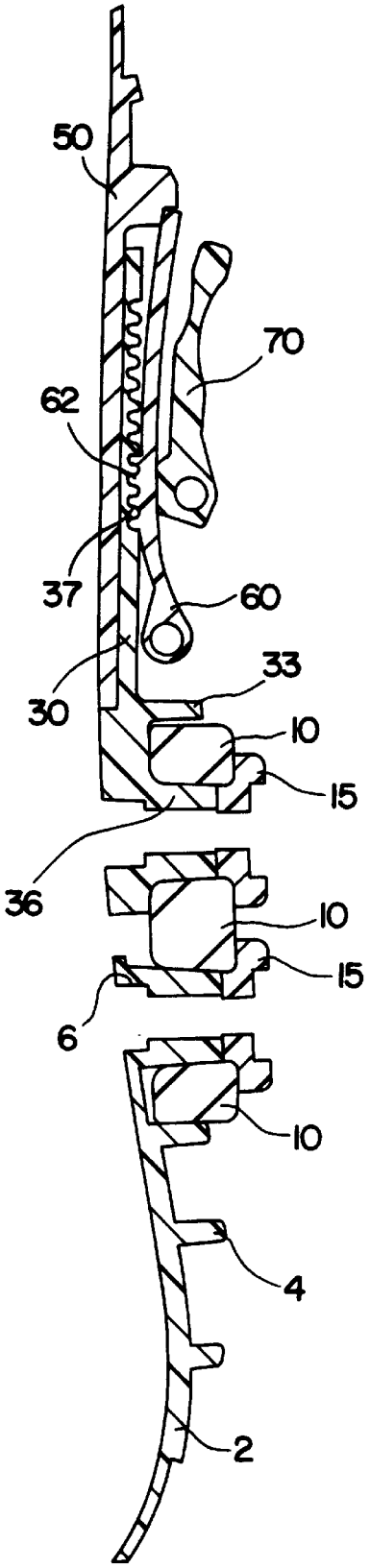
FIG. 7*a* is an enlarged cross-sectional view of a preferred embodiment of the present invention along the line A—A shown in FIG. 6.

A cover plate 60 is pivotally mounted to the upper cuff 50 with a pin 61 such that in its closed position the cover plate 60 contacts the engaging portion 34 of the tongue member 30 as shown in FIG. 7. The cover plate 60 also extends over and covers the receiving channel 56 so that snow and other particulate matter will not accumulate inside the receiving channel 56. A plurality of teeth 62 that mate with the teeth of the tongue member 37 are disposed on the inner surface of the cover plate 60 as shown in FIG. 7*a*. When these teeth 62 are engaged with the teeth on the tongue member 37, the vertical position of the upper cuff 50 with respect to the heel cuff 2 is fixed. By adjusting the relative vertical position to which these teeth are engaged the user can adjust the forward leaning position of the footwear.

Figure 8A:
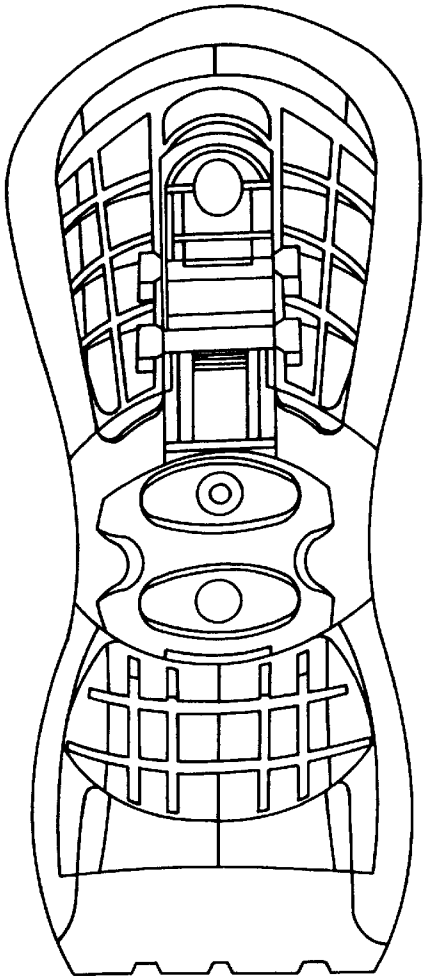
FIG. 8*a* is a rear view of a preferred embodiment of the present invention adjusted to a forward leaning position.
Figure 8:
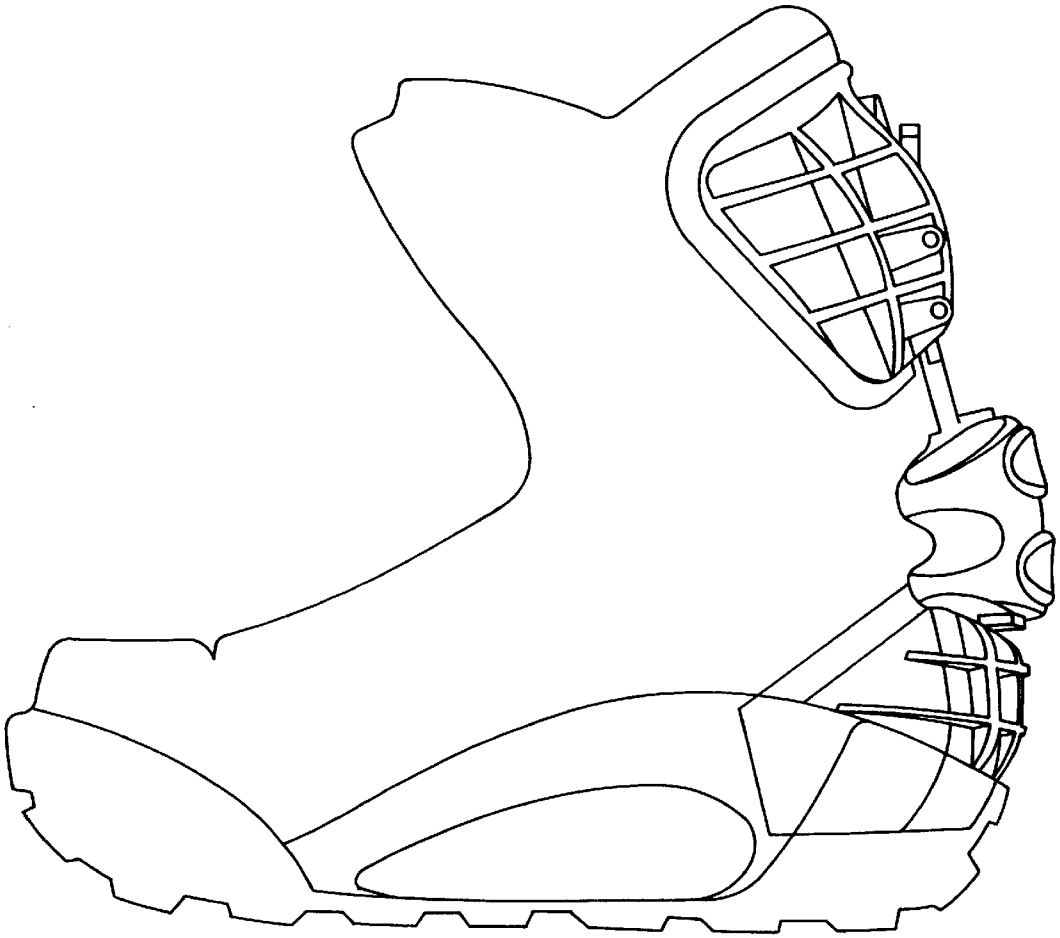
FIG. 8 is a side view of a preferred embodiment of the present invention adjusted to a forward leaning position.
Figure 9A:
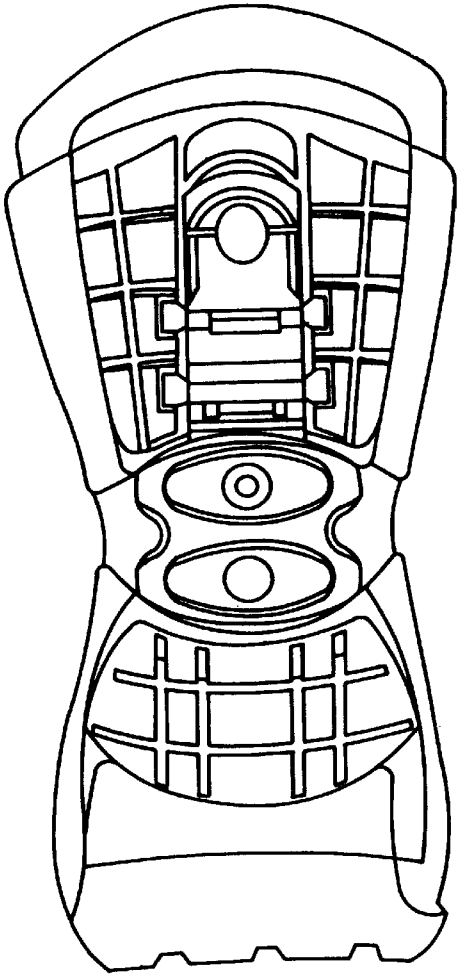
FIG. 9*a* is a rear view of a preferred embodiment of the present invention with the highback positioned for walking.
Figure 9:
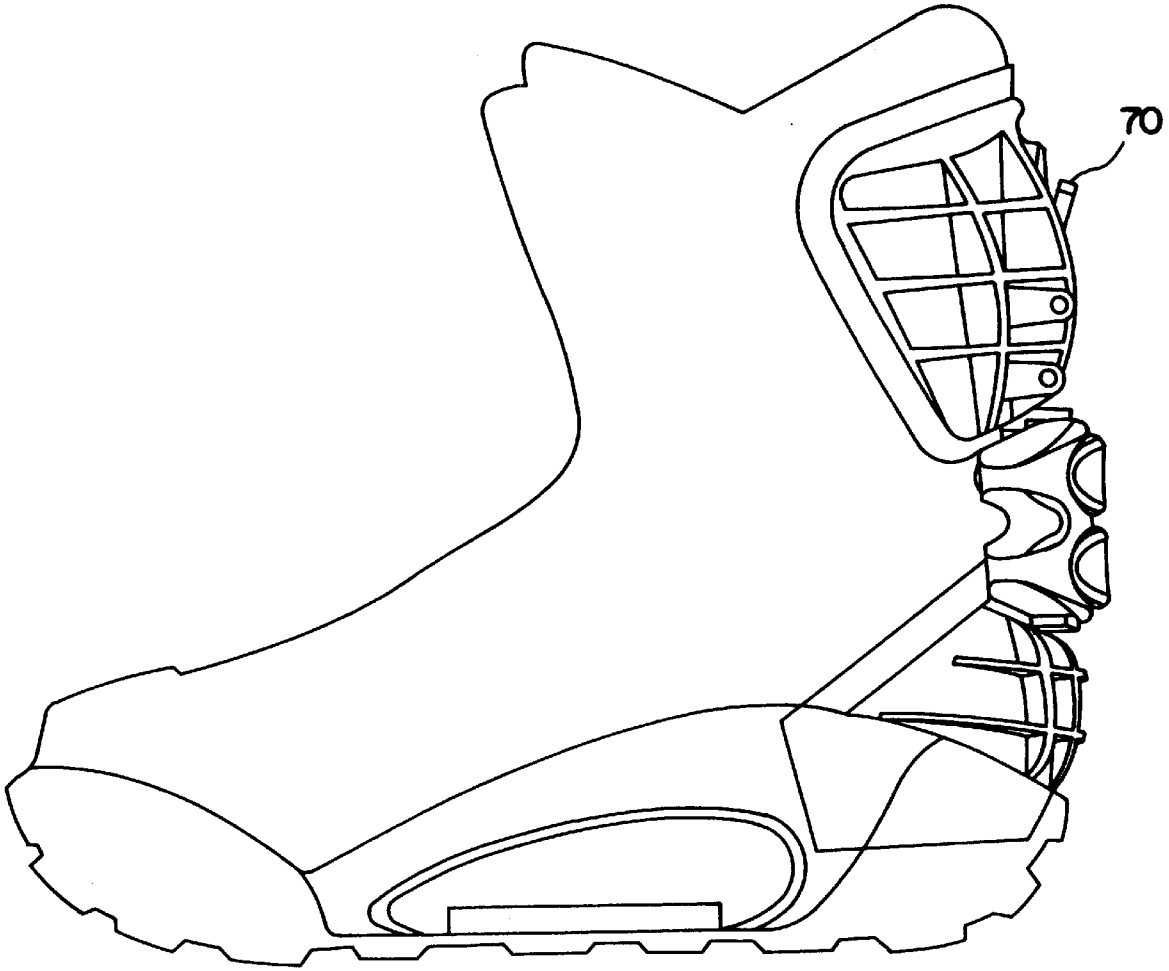
FIG. 9 is a side view of a preferred embodiment of the present invention with the highback positioned for walking.

A cam lever 70 is pivotally mounted on the upper cuff 50 with a pin 71 and engages the cover plate 60. The cam lever 70 is angled at its top to facilitate the user's ability to grip and position the lever 70. When operated, the cam lever 70 locks the cover plate 60 into the receiving channel 56 thereby securing the forward lean adjusted position by engaging the teeth of the cover plate 60 with the teeth of the tongue member 30 (see FIGS. 7*a* and 8). Together, the cam lever, cover plate and the engaging portion of the tongue member comprise a locking assembly for securing the adjusted forward lean position. When the user desires to walk freely in the footwear, the cam lever 70 is opened to release the cover plate. The cover plate 60 is thereby disengaged from the teeth of the tongue member 30 to permit the tongue member 30 to move freely vertically within the receiving channel 56 of the upper cuff 50 and the footwear returns to an upright position, as shown in FIG. 9. The free movement of the tongue member 30 results in the footwear being in a flexible state suitable for walking. To facilitate the disengagement of the cover plate 60 from the tongue member 30 when the cam lever 70 is released, the cover plate 60 can be fitted with strips of spring steel or other spring mechanisms.

Although not shown in the figures, it is contemplated that the boot can be adapted with a "stretch panel" in the vicinity of the boot corresponding to the forward portion of the user's ankle. The stretch panel comprises a panel of elastic material that is substituted for the boot material in a finite region of the boot to prevent a "bunch up" interference that would otherwise be caused by the boot material when the boot is adjusted to a forward leaning position.

While the preferred embodiment depicts the tongue member 30 engaging the upper cuff 50 to adjust and secure the forward leaning position of the footwear, one of ordinary skill in the art will readily appreciate that the heel cuff 2 could be adapted to receive the tongue member 30 and the upper cuff 50 could be adapted with a hub.

Figure 10:
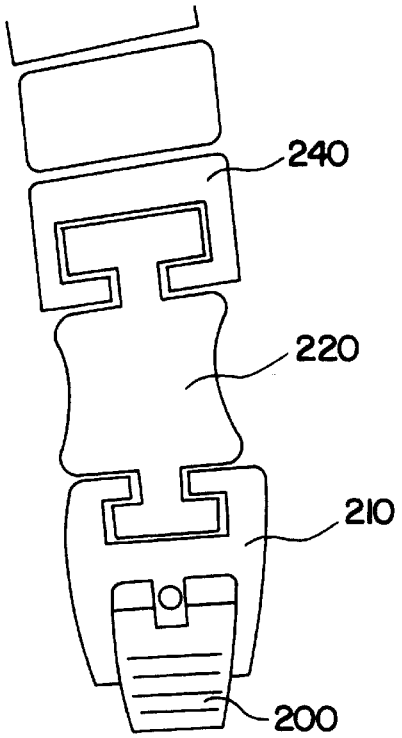
FIG. 10 is a front view of an alternative embodiment of the present invention.
Figure 11:
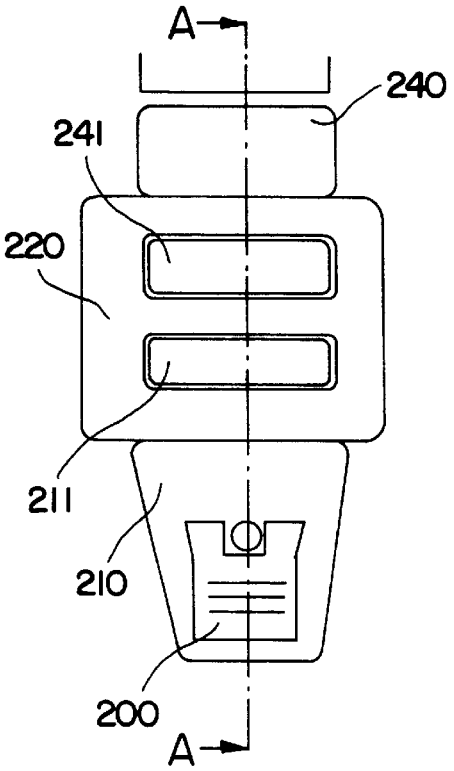
FIG. 11 is a front view of an alternative aspect of the alternative embodiment of the present invention.
Figure 11A:
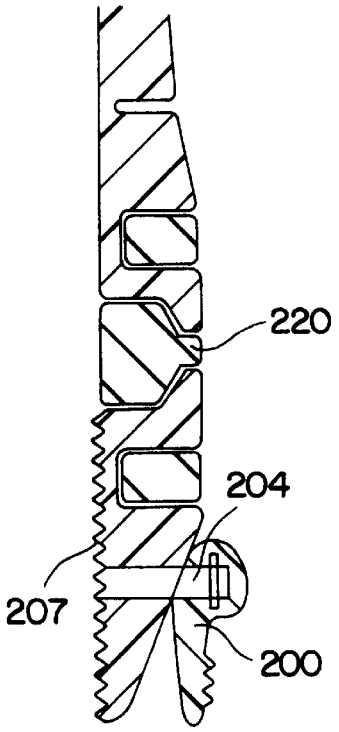
Figures 1, 12A:
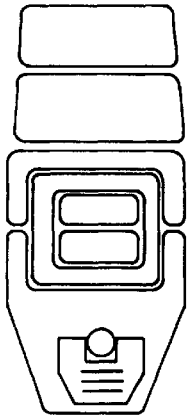
FIGS. 12A, 12B, 12C and 12D are front and side views showing various shapes of the flexible connecting member of the present invention.
Figures 2, 12A:
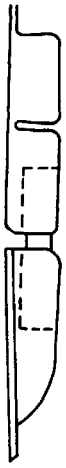
Figures 1, 12B:
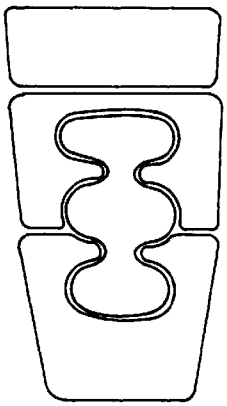
Figures 2, 12B:
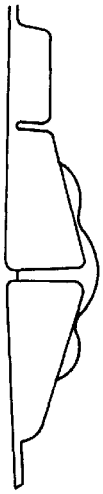
Figures 1, 12C:
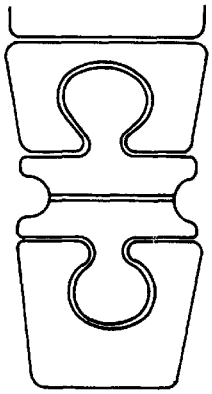
Figures 2, 12C:
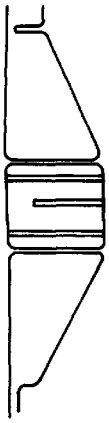
Figures 1, 12D:
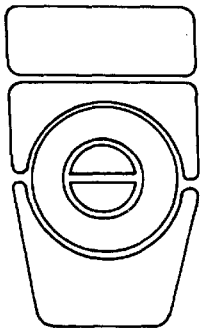
Figures 2, 12D:
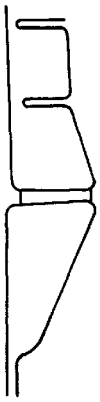

In an alternative embodiment of the present invention, as shown in FIGS. 10, 11 and 11*a*, the upper cuff is connected to the removable flexible connecting member 220. The heel cuff 210 contains an inner surface with teeth 207 that mate with teeth on the outer portion of the heel of the footwear. A cam lever 200, mounted at the end of a post 204 and secured to the heel of the footwear, engages the heel cuff. Operation of the cam lever 200 secures the heel cuff 210 to the outer heel of the footwear, thereby fixing the forward lean position of the footwear. Although not shown in the figures, the heel cuff 210 contains a vertical channel in which the post 204 securing the cam lever to the heel of the footwear is disposed. This channel permits vertical movement of the heel cuff 210 such that the forward lean position can be varied by varying the vertical position at which the heel cuff 210 engages the heel portion of the footwear. As shown in FIGS. 12*a*, 12*b*, 12*c*, and 12*d*, the shape of the flexible connecting member can be varied to achieve aesthetic designs as well as to influence the stiffness of the connecting member 220 and resulting stiffness of the footwear.

Figure 13:
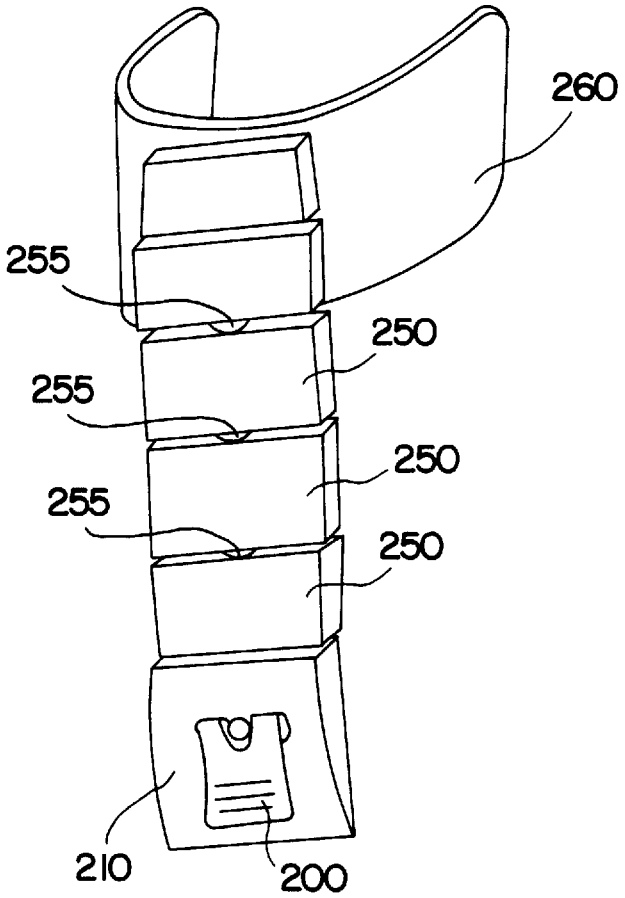
FIG. 13 is a perspective view of a second alternative embodiment of the present invention.

In an alternative aspect of the aforesaid alternative embodiment of the present invention, the flexible connecting member is replaced by a plurality of interconnected spine members 250 comprised of polymer blocks, as shown in FIG. 13. A flexible rod 255 connects the spine members to each other and to the upper cuff 260 and the heel cuff 210.

It is contemplated that the below listed components of the highback of the present invention may be formed from the following materials: the upper cuff and heel cuff may be formed of thermal plastic urethane, the cover plate may be formed from polycarbonate, the cam lever, retaining caps and tongue member may be formed from glass filled nylon, the flexible connecting member may be formed of an elastomer material such as Kraton™ or thermal plastic urethane, and the pins may be formed of stainless steel.

As shown and described above, the present invention provides a footwear, such as a boot or skate, that permits the wearer to comfortably walk yet also permits that footwear to be used for intended sports activity. Additionally, the present invention permits the user to adjust and set the forward leaning position of the footwear to engage in sports activities. Further, the present invention provides for a footwear that, while maintaining the footwear in a substantially rigid forward leaning position, still permits movement of the footwear based on side to side or rotational movement of the user.

It is specifically contemplated that the present invention may be modified or configured as appropriate for the application. It is intended that the foregoing detailed description be regarded as illustrative rather than limiting, and it should be understood that the following claims, including any equivalents, are intended to define the scope of the invention.

What is claimed is:

1. A highback comprising:

a heel cuff, a tongue member;

an upper cuff;

a flexible connecting member, which connects said heel cuff to said tongue member; and means for securing said tongue member at a fixed position within said upper cuff.

2. The highback of claim 1 wherein the said flexible connecting member is made from an elastomer.

3. The highback of claim 1 wherein the said highback is secured to a snowboard boot.

4. A highback comprising:

a heel cuff;

a first hub connected to said heel cuff;

a tongue member, said tongue member further comprising a base and an engaging portion;

an upper cuff having a receiving cavity for receiving the engaging portion of said tongue member;

a flexible connecting member connected to said first hub and connected to the base of said tongue member; and a locking assembly operable to secure the engaging portion of said tongue member in a fixed position within the receiving cavity of said upper cuff.

5. The highback of claim 4 wherein said locking assembly further comprises:

a cover plate secured to said upper cuff, said cover plate operable to engage the engaging portion of said tongue member; and a cam lever pivotally mounted to said upper cuff and operably associated with said cover plate to lock the engaging portion of said tongue member in the receiving cavity of said upper cuff at a fixed position.

6. The highback of claim 5 wherein said engaging portion of said tongue member is comprised of a plurality of teeth and said cover plate is comprised of a plurality of teeth that matingly engage the teeth of said tongue member.

7. The highback of claim 4 wherein said base of said tongue member comprises a second hub that is connected to said flexible connecting member.

8. The highback of claim 7 further comprising:

a first removable retaining cap for securing said flexible connecting member to said first hub; and a second removable retaining cap for securing said flexible connecting member to said second hub.

9. The highback of claim 7 wherein said second hub is integral with said tongue member.

10. The highback of claim 7 wherein said first hub and said second hub are elliptically shaped.

11. The highback of claim 4 wherein said flexible connecting member comprises an elastomer material.

12. The highback of claim 4 wherein said flexible connecting member comprises thermal plastic urethane.

13. The highback of claim 4 further comprising at least one removable retaining cap for securing said flexible connecting member to said first hub.

14. The highback of claim 4 wherein said flexible connecting member comprises at least one side cut away.

15. The highback of claim 4 wherein said tongue member further comprises at least one guide rail adapted to guide said tongue member into the receiving cavity of said upper cuff.

16. The high back of claim 4 wherein said first hub is integral with said heel cuff.

17. The highback of claim 4 further comprising a first ridge connected to and projecting from said heel cuff wherein a portion of said flexible connecting member is disposed between said first hub and said first ridge.

18. The highback of claim 7 further comprising a second ridge connected to and projecting from said tongue member wherein a portion of said flexible connecting member is disposed between said second hub and said second ridge.

19. The highback of claim 4 wherein said heel cuff further comprises a lattice of stiffening ribs.

20. The highback of claim 4 wherein said upper cuff further comprises a lattice of stiffening ribs.

21. A highback comprising:

a heel cuff;

an upper cuff;

a tongue member;

a flexible connecting member;

means for connecting said flexible connecting member to said heel cuff and said tongue member; and means for fixing said tongue member at a position within said upper cuff.

22. The highback of claim 21 wherein said means for connecting said flexible connecting member to said heel cuff and said tongue member further includes:

means for securing said flexible connecting member to said heel cuff and said tongue member in a secured connection; and means for removing said flexible connecting member from said secured connection.

* * * * *